US005538247A

United States Patent [19]

Liao

[11] Patent Number: 5,538,247

[45] Date of Patent: Jul. 23, 1996

[54] INTELLECTUAL KNOCKDOWN MAZE

[76] Inventor: Jung-Hui Liao, No. 17, Yih-Min Street, Tour-Fenn Jenn, Miau-Lih Hsien, Taiwan

[21] Appl. No.: 557,639

[22] Filed: Nov. 14, 1995

[51] Int. Cl.[6] ..... A63F 7/04

[52] U.S. Cl. ..... 273/153 R; 273/110

[58] Field of Search ..... 273/153 R, 108, 273/109, 110, 118 R

[56] References Cited

U.S. PATENT DOCUMENTS

| | | | |
|---|---|---|---|
| 414,986 | 11/1889 | Motter | 273/110 |
| 417,931 | 12/1889 | Miatt | 273/153 R |
| 579,485 | 3/1897 | Jensen | 273/109 |
| 2,011,266 | 8/1935 | Boynton | 273/153 R |
| 2,956,807 | 10/1960 | Luchsinger | 273/108 X |
| 3,540,731 | 11/1970 | Muncey | 273/109 |

FOREIGN PATENT DOCUMENTS

| | | |
|---|---|---|
| 4232505 | 3/1994 | Germany . |
| 9407841 | 4/1994 | WIPO . |

OTHER PUBLICATIONS

H. Adkins, et al., J. Am. Chem. Soc., vol. 69, pp. 3039–3041, (1947).

H. S. Broadbent, et al., J. Org. Chem., vol. 24, pp. 1847–1854, (1959).

E. Segel, J. Am. Chem. Soc., vol. 74, No. 4, p. 1096; (1952).

A. Abiko, et al., Tetrahedron Letters, vol. 33, No. 38, pp. 5517–5518, (1992).

R. Luckenbach, Beilsteins Handbuch der Organischen Chemie, Viertes, Ergänzungswerk, vol. IV, pp. 1797–1798, Springer–Verlag, New York, (1979).

P. Karrer, et al., Helvetica Chimica Acta, vol. 31, pp. 1617–1623, (1948).

H. Seki, et al., Chem. Pharm. Bull., vol. 13, No. 8, pp. 995–1000, (1965).

H. C. Brown, et al., J. Am Chem. Soc., vol. 78, pp. 2582–2588, (1956).

Houben–Weys, Methoden der Org. Chemie, 4th Ed., vol. VI/1b, pp. 103–107, 206 and 214. (1987).

H. Adkins, et al., J. Am. Chem. Soc., vol. 70, pp. 3121–3125, (1948).

*Primary Examiner*—William H. Grieb

*Attorney, Agent, or Firm*—Pro-Techtor International

[57] ABSTRACT

An intellectual knockdown maze including a plane seat board, several long and short side blocks with different lengths and four groups of L-shaped component blocks. The seat board is disposed with longitudinal and transverse partitioning lines which intersect each other at multiple intersections disposed with insertion holes. Each of the side block and L-shaped component block is formed with an insertion tenon on lower side for inserting into the insertion hole so as to locate the side blocks and component blocks on the seat board. The side blocks serve to form side walls of the maze and the component blocks serve to form partitioning walls of the maze. The lengths of the long and short side blocks are such that two long side blocks are arranged side by side along entire length of one side of the seat board to form a side wall of the maze, while a long side block and a short side block are arranged side by side along one side of the seat board to leave an entrance or an exit notch thereon. Each side block is formed with a slide channel on inner upper edge, whereby a transparent acrylic board corresponding to the seat board is assembled with the side blocks to cover the component blocks and form a close pattern of maze. A steel ball is placed in the maze for a player to shake the seat board so as to roll the steel ball through a desired path to the exit notch.

7 Claims, 3 Drawing Sheets

INTELLECTUAL KNOCKDOWN MAZE

BACKGROUND OF THE INVENTION

The present invention relates to an intellectual knockdown maze including side blocks and component blocks which can be freely optionally arranged on a seat board to define various maze paths. The pattern of the arrangement of the side blocks and component blocks is changeable by a player. This serves to train the maze path design ability of the player.

Conventional maze designs generally include plane maze and solid maze. These two types of mazes both have fixed pattern and path. Therefore, for a player skilled in passing through the fixed path of the maze, the maze can no more attract and provide entertaining effect for the player. Moreover, due to the fixed pattern and considerably large volume of the conventional maze, it is inconveniently to pack or carry the conventional maze.

SUMMARY OF THE INVENTION

It is therefore a primary object of the present invention to provide an intellectual knockdown maze including a plane seat board, several long and short side blocks with different lengths and four groups of L-shaped component blocks. The seat board is disposed with longitudinal and transverse partitioning lines which intersect each other at multiple intersections disposed with insertion holes. Each of the side blocks and L-shaped component blocks is formed with an insertion tenon on a lower side for inserting into the insertion holes so as to locate the side blocks and component blocks on the seat board. The side blocks serve to form side walls of the maze and the component blocks serve to form partitioning walls of the maze. The lengths of the long and short side blocks ere such that two long side blocks are arranged side by side along entire length of one side of the seat board to form a side wall of the maze, while a long side block and a short side block are arranged side by side along one side of the seat board to leave an entrance or an exit notch thereon. Each side block is formed with a slide channel on an inner upper edge, whereby a transparent acrylic board corresponding to the seat board is assembled with the side blocks to cover the component blocks and form a close pattern of maze. A steel ball is placed in the maze for a player to shake the seat board so as to roll the steel ball through a desired path to the exit notch. The side blocks and component blocks can be freely optionally arranged on the seat board to define various maze paths. The pattern and number of the side blocks and component blocks and the path of the maze are changeable by a player to form different types of mazes with different levels of difficulty. This serves to train the maze path design ability of the player and provides great entertaining effect for the player.

It is a further object of the present invention to provide the above knockdown maze in which a support seat is disposed under the seat board to support the same. The support seat has a rectangular base board and a conic projection upward projecting from the base board. In cooperation with the conic projection, a central portion of the bottom of the seat board is formed with an insertion recess. The conic projection of the support seat is inserted into the insertion recess to support the seat board on the support seat, permitting the seat board to be freely inclined and rotated so as to roll the steel ball.

It is still a further object of the present invention to provide the above knockdown maze in which the seat board is made of magnetic material and the side blocks and the component blocks are made of metal material, whereby the side blocks and the component blocks are more easily assembled with the seat board by magnetic attractional force without the insertion holes and insertion tenons.

It is still a further object of the present invention to provide the above knockdown maze in which a long and a short arm are foldably assembled with each other to form a joint type component block. The angle contained by the long and short arms is adjustable for locating the component block at a different position on the seat board.

The present invention can be best understood through the following description and accompanying drawing, wherein:

DETAILED DESCRIPTION OF THE PREFERRED EMBODIMENTS

Figure 1:
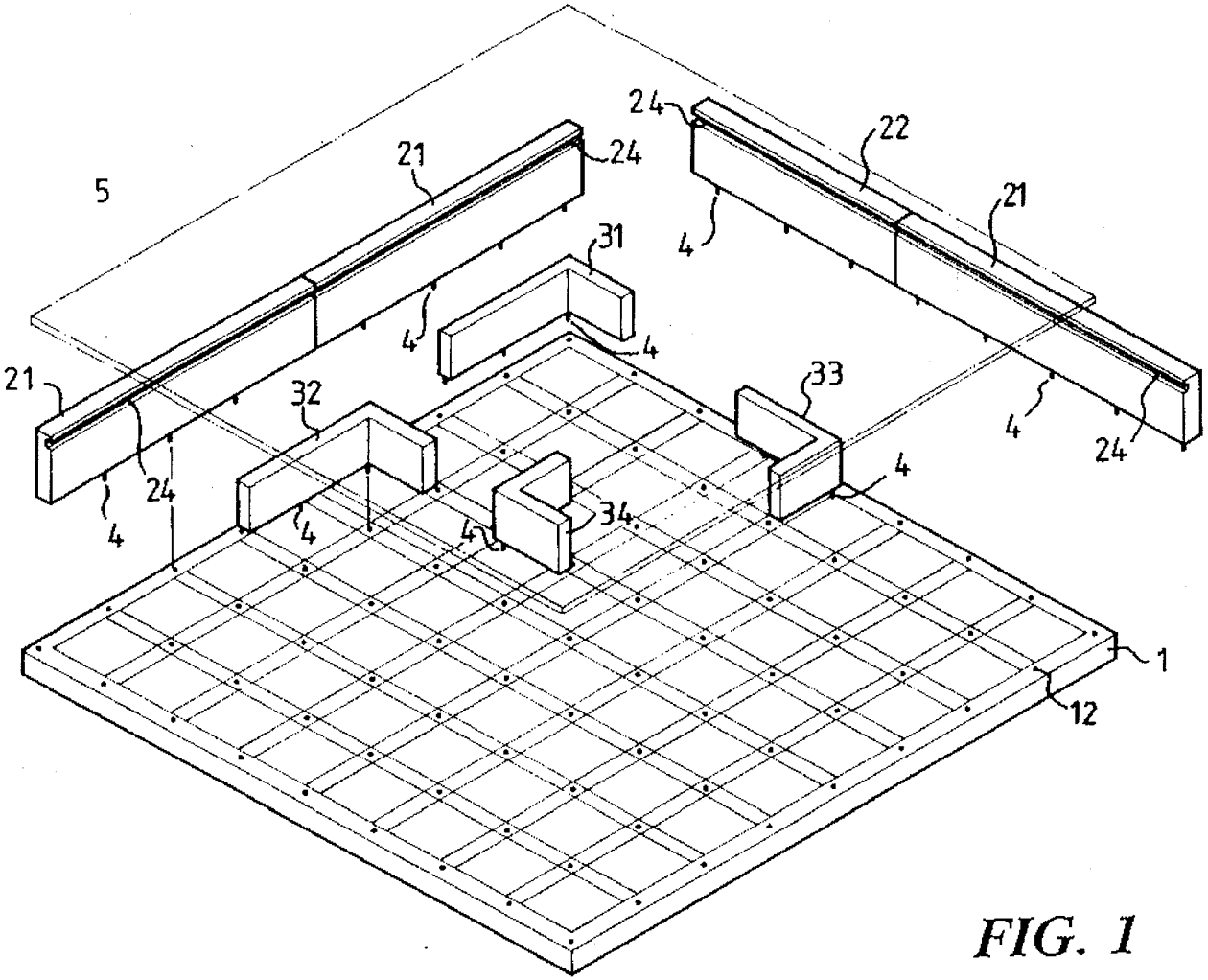
FIG. 1 is a perspective exploded view of the present invention.
Figure 4:
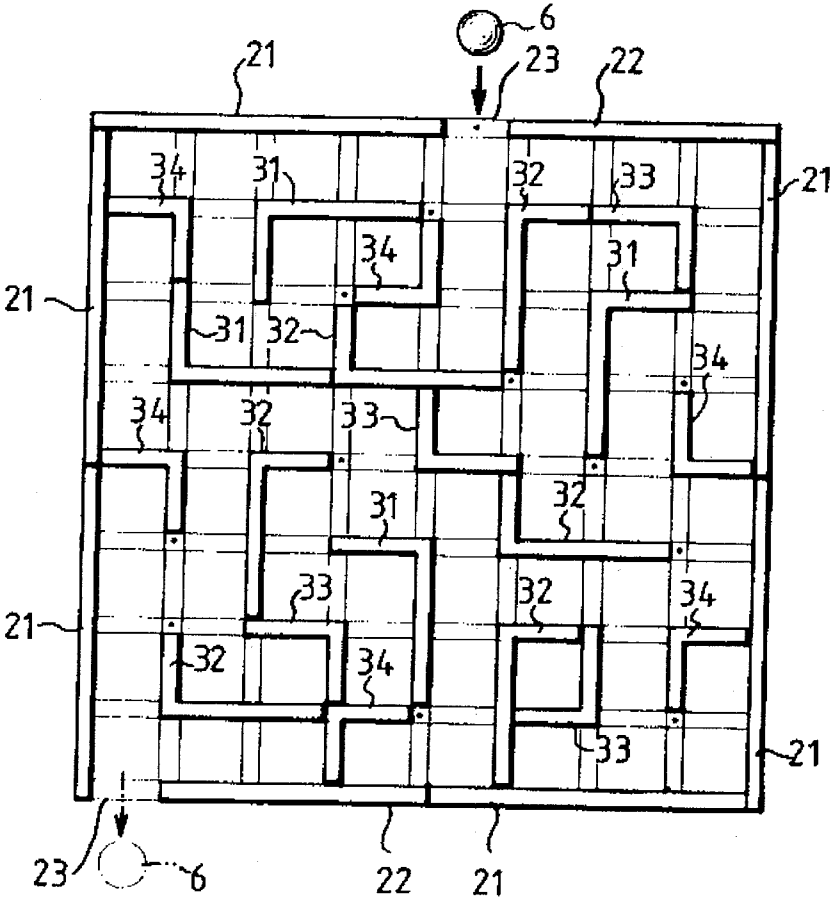
FIG. 4 shows another embodiment of the present invention.
Figure 3:
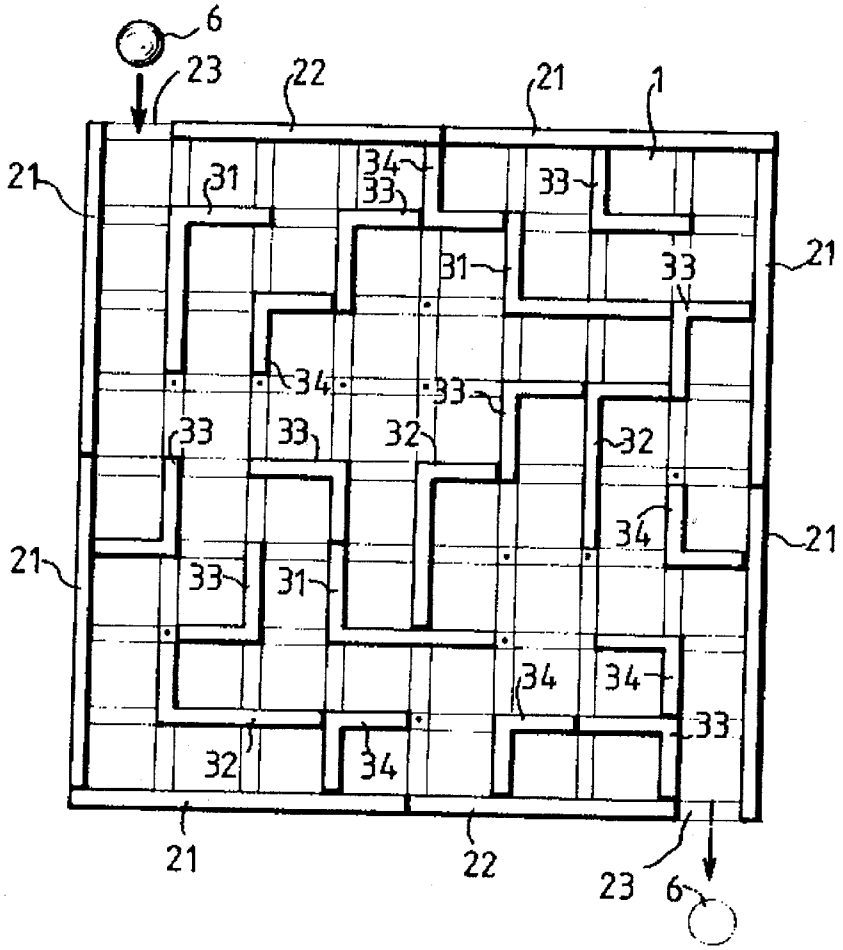
FIG. 3 shows an embodiment of the present invention.

Please refer to FIG. 1. The intellectual knockdown maze of the present invention mainly includes a plane seat board 1, several long and short side blocks 21, 22 with different lengths and four groups of L-shaped component blocks 31, 32, 33, 34. The seat board 1 is disposed with regularly arranged longitudinal and transverse partitioning lines which intersect each other at multiple intersections. Each intersection is disposed with an insertion hole 12. Each of the side block 21, 22 and L-shaped component block 31, 32, 33, 34 is formed with an insertion tenon 4 on lower side corresponding to the insertion hole 12. Therefore, the side blocks 21, 22 and the component blocks 31, 32, 33, 34 can be located on the seat board 1 by means of inserting the insertion tenons 4 into the insertion holes 12. Each long side block 21 has such a length that two long side blocks 21 can be arranged side by side along entire length of one side of the seat board 1 to form a side wall of the maze. Each short side block 22 has such a length that a long side block 21 and a short side block 22 can be arranged side by side along one side of the seat board 1 to leave a notch 23 thereon as shown in FIGS. 3 and 4. Moreover, each side block 21, 22 is formed with a slide channel 24 on inner upper edge, whereby a transparent acrylic board 5 corresponding to the seat board 1 can be assembled with the side blocks 21, 22 to cover the component blocks and form a close pattern of maze.

Figure 2:
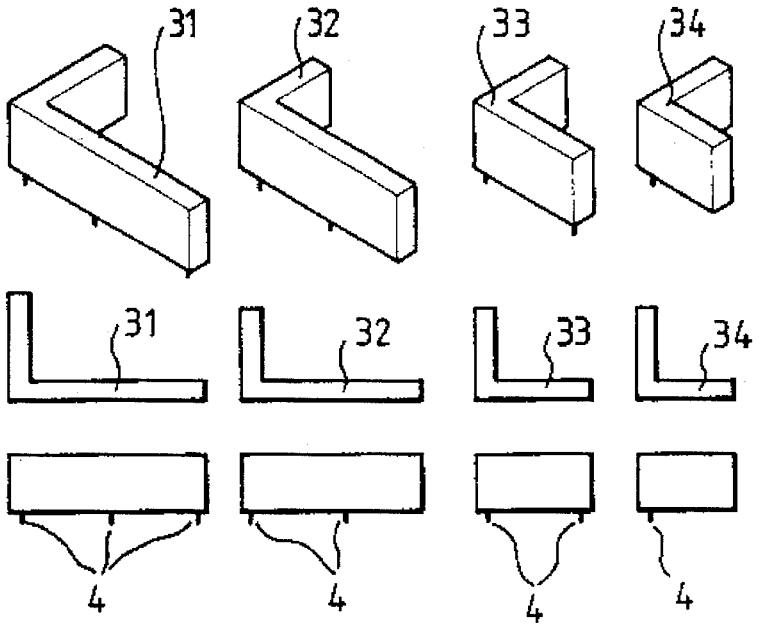
FIG. 2 shows the respective component blocks of the present invention.

Please refer to FIG. 2. The four groups of L-shaped component blocks 31, 32, 33, 34 serve to form the partitioning walls of the maze and have different lengths of two arms and different numbers of the insertion tenons, wherein the first component block 31 has three equally spaced insertion tenons 4 along its long arm, the second component block 32 has two unequally spaced insertion tenons 4 along its long arm, the third component block 33 has two equally spaced insertion tenons 4 along its long arm, while the fourth component block 34 has one insertion tenon 4 on its one arm. By means of the different numbers of insertion tenons 4, the respective component blocks can be cooperatively inserted on the seat board 1 along the longitudinal and transverse partitioning lines thereof to form an array of partitioning walls.

Please refer to FIG. 3 which shows an embodiment of the intellectual knockdown maze, wherein a long and a short side blocks 21, 22 are located along an upper side of the seat board 1 to form an entrance notch 23 on upper left corner thereof. In addition, a long and a short side blocks 21, 22 are located along a lower side of the seat board 1 to form an exit notch 23 on lower right corner thereof. FIG. 4 shows another arrangement of the side blocks 21, 22, wherein the entrance notch 23 is positioned substantially at a middle portion of the upper side of the seat board 1, while the exit notch 23 is positioned on the lower left corner of the seat board 1. The notch 23 can be alternatively disposed on other portions of the seat board 1 according to the requirement of a player. The different lengths of component blocks 31 32, 33, 34 can be arranged into various maze patterns on the seat board 1 along the longitudinal and transverse partitioning lines. In addition, the component blocks 31, 32, 33, 34 can be interchanged in number and position to form a simpler or a more complicated maze. Therefore, the component blocks can be freely optionally arranged on the seat board 1 to train the design ability of the player. Moreover, a steel ball 6 can be placed in the maze and the player can shake the seat board 1 so as to roll the steel ball 6 through the desired path to the exit notch. This procedure provides an entertaining effect for the player.

Figure 5:
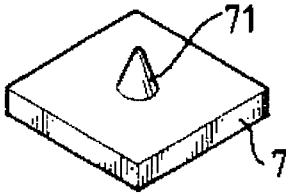
FIG. 5 is a perspective view of the support seat of the present invention.
Figure 6:
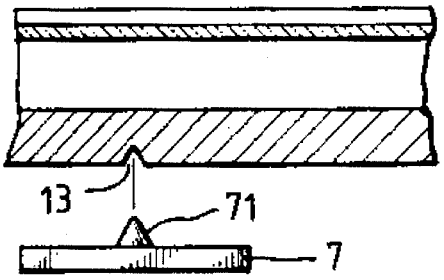
FIG. 6 is a sectional view showing that the conic projection of the support seat is inserted in the insertion recess of the seat board for supporting the same.

Please refer to FIGS. 5 and 6. A support seat 7 can be disposed under the seat board 1 to support the same. The support seat 7 has a rectangular base board and a conic projection 71 upward projecting from the base board. In cooperation with the conic projection 71, a central portion of the bottom of the seat board 1 is formed with an insertion recess 13. The conic projection 71 of the support seat 7 can be inserted into the insertion recess 13 to support the seat board 1 on the support seat 7. Therefore, the seat board 1 can be freely inclined or rotated to roll the steel ball 6 in various directions.

Alternatively, the seat board 1 can be made of magnetic material and the side blocks 21, 22 and the component blocks 31, 32, 33, 34 can be made of metal material, whereby the side blocks and the component blocks can be more easily assembled with the seat board 1 by magnetic attractional force without the insertion holes and insertion tenons.

Figure 7:
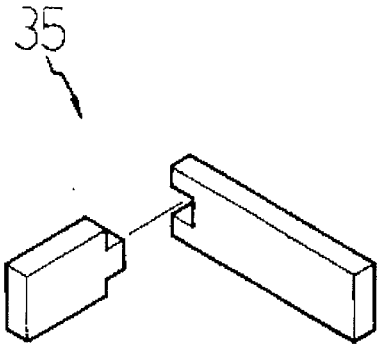
FIG. 7 is a perspective exploded view of the joint type component block of the present invention.

FIG. 7 shows another embodiment of the component block 35 which includes a long arm and a short arm. The long arm is formed with an insertion recess at one end, while the short arm is formed with an insertion projection at one end corresponding to the insertion recess of the long arm. The insertion projection of the short arm is foldably inserted into the insertion recess of the long arm so as to assemble the long arm with the short arm to form a joint type component block 35 in which the angle contained by the long and short arms can be adjusted for different use.

It is to be understood that the above description and drawings are only used for illustrating some embodiments of the present invention, not intended to limit the scope thereof. Any variation and derivation from the above description and drawings should be included in the scope of the present invention.

What is claimed is:

1. An intellectual knockdown maze comprising a plane seat board, several long and short side blocks with different lengths and four groups of L-shaped component blocks, wherein:

the seat board is disposed with regularly arranged longitudinal and transverse partitioning lines which intersect each other at multiple intersections, each intersection being disposed with an insertion hole, each of the side block and L-shaped component block being formed with an insertion tenon on lower side corresponding to the insertion hole, the side blocks and the component blocks being located on the seat board by means of inserting the insertion tenons into the insertion holes, the long and short side blocks serving to form side walls of the maze; and the four groups of L-shaped component blocks serving to form partitioning walls of the maze and have different lengths of two arms and different numbers of the insertion tenons, wherein a first component block has three equally spaced insertion tenons along its long arm, a second component block has two unequally spaced insertion tenons along its long arm, a third component block has two equally spaced insertion tenons along its long arm, while a fourth component block has one insertion tenon on its one arm, by means of the different numbers of insertion tenons, the respective component blocks being cooperatively inserted on the seat board along the longitudinal and transverse partitioning lines thereof to form an array of partitioning walls.

2. An intellectual knockdown maze as claimed in claim 1, wherein each long side block has such a length that two long side blocks are arranged side by side along entire length of one side of the seat board to form a side wall of the maze, while each short side block has such a length that a long side block and a short side block are arranged side by side along one side of the seat board to leave a notch thereon.

3. An intellectual knockdown maze as claimed in claim 1, wherein each side block is formed with a slide channel on an inner upper edge, whereby a transparent acrylic board corresponding to the seat board is assembled with the side blocks to cover the component blocks and form a close pattern of maze.

4. An intellectual knockdown maze as claimed in claim 1, wherein a steel ball is placed in the maze for a player to shake the seat board so as to roll the steel ball through a desired path to an exit notch.

5. An intellectual knockdown maze as claimed in claim 1, wherein a support seat is disposed under the seat board to support the same, the support seat having a rectangular base board and a conic projection upward projecting from the base board, in cooperation with the conic projection, a central portion of the bottom of the seat board being formed with an insertion recess, the conic projection of the support seat being inserted into the insertion recess to support the seat board on the support seat.

6. An intellectual knockdown maze as claimed in claim 1, wherein the seat board is made of magnetic material and the side blocks and the component blocks are made of metal material, whereby the side blocks and the component blocks are assembled with the seat board by magnetic attractional force.

7. An intellectual knockdown maze as claimed in claim 1, wherein the component block includes a long arm and a short arm, the long arm being formed with an insertion recess at one end, while the short arm being formed with an insertion projection at one end corresponding to the insertion recess of the long arm, the insertion projection of the short arm being foldably inserted into the insertion recess of the long arm so as to assemble the long arm with the short arm to form a joint type component block in which an angle contained by the long and short arms is adjustable.

* * * * *